United States Patent [19]

Steeves

[11] 4,177,314

[45] Dec. 4, 1979

[54] METHOD OF PRINTING PAPER

[75] Inventor: Robert W. Steeves, Nahant, Mass.

[73] Assignee: King Seeley Thermos Company, Winchester, Mass.

[21] Appl. No.: 954,524

[22] Filed: Oct. 25, 1978

[51] Int. Cl.[2] ..... B05D 3/06

[52] U.S. Cl. ..... 428/336; 427/44; 428/335; 428/514

[58] Field of Search ..... 427/44, 54, 411; 428/511, 514, 335, 336

[56] References Cited

U.S. PATENT DOCUMENTS

| | | | |
|---|---|---|---|
| 3,279,424 | 10/1966 | Brown et al. | 427/362 |
| 3,361,842 | 1/1968 | Applegath et al. | 427/44 |
| 3,966,573 | 6/1976 | Bean | 428/514 |

*Primary Examiner*—John H. Newsome

*Attorney, Agent, or Firm*—Harness, Dickey & Pierce

[57] ABSTRACT

A printed paper product useful in graphic, packaging and decorating applications is provided by a process of coating a paper substrate with a radiation curable resin precursor, immediately curing the precursor by means of an electron beam to provide a smooth resin film and then printing on the exposed surface of the resin film.

14 Claims, 1 Drawing Figure

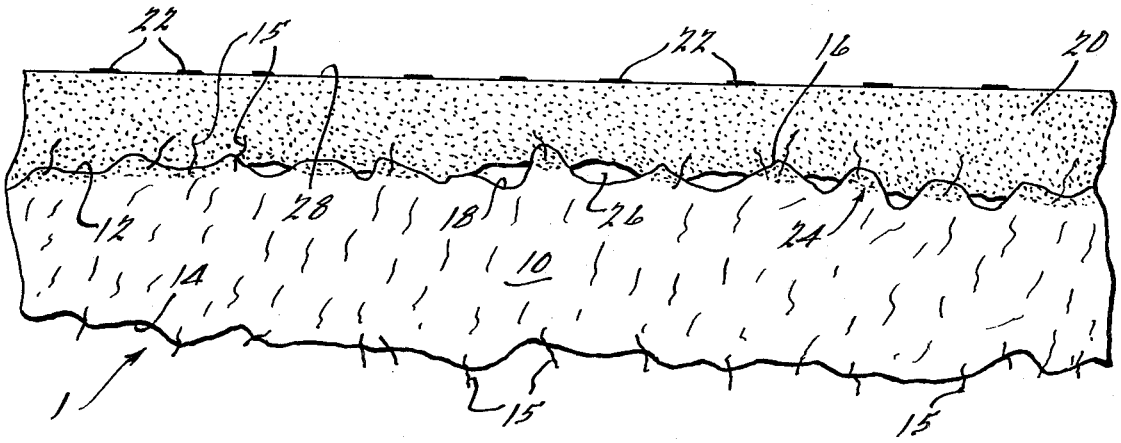
22
15
22
16
20
12
28
18
26
24
10
14
1
15
15

METHOD OF PRINTING PAPER

BACKGROUND OF THE INVENTION

The present invention relates to a method of making a printed paper product. More particularly, the present invention relates to a method of coating a paper substrate with a smooth thin resin surface and printing thereon.

While it is known to chemically treat a paper substrate pursuant to printing thereon, there remains a need for an economical method by which glossy-paper with brightly colored images can be produced. Conventional printing processes often involve printing the same material twice in order to locate a sufficient amount of ink on the surface of glossy paper to provide a satisfactory image thereon because the smooth paper surface has little affinity for the ink. On the other hand, if a paper substrate has a relatively rough and absorbent surface excessive amounts of ink and hence expense are required for satisfactory results because much of the ink is absorbed beneath the surface of the paper.

Wherefore, it is an object of the present invention to provide an improved method for providing a thin coating layer on a paper substrate which will impart a glossy finish thereto and yet which is receptive to printing ink. It is another object of this invention to provide an improved paper product comprising a paper substrate having a thin resin coating having inked images thereon. Yet another object of the invention is to provide a method particularly suited for discrete, continuous, high speed paper coating and printing operations and which is economical and energy efficient. A still further object of this invention is to provide a paper product having good strength and flexibility and which is useful for magazine pages, packaging, decorative and other applications and for which a printed paper substrate is suitable. These and other objects features and advantages will be apparent from the following description and appended claims, taken in conjunction with the accompanying drawing.

BRIEF DESCRIPTION OF THE DRAWING

The FIGURE is a cross-sectional view of a printed paper product of the present invention.

DESCRIPTION OF THE INVENTION

Now referring to the drawing, the FIGURE shows a paper substrate 10 with a surface 12 and an opposite surface 14, of an irregular nature having fibers 15 extending therefrom and peaks 16 and valleys 18. Surface 12 is coated with resin film 20 having an outer surface 28 which has an image printed thereon comprising discrete ink portions 22. Of course it will be understood that ink portions 22 can be a continuous coating or layer. Resin film 20 is impregnated a small distance into paper substrate 10 as indicated at areas 24. The irregularity of surface 12 and degree of hold out of resin film 20 is such that pockets or holes 26 are trapped between resin film 20 and paper substrate 10. However outer surface 28 of resin film 20 is relatively smooth and presents a glossy appearance. Paper substrate 10, resin film 20 and ink portions 22 are not shown to scale. Materials, sizes and other characteristics of the printed paper product of the present invention will be understood from the disclosure relating to the method of this invention which is set forth hereinafter.

The printed paper product of the present invention is useful for magazine pages, posters, packaging, decorating and other applications. A product made in accordance with this invention is flexible for continuous printing operations, has good strength, and presents a smooth, glossy surface with printed images thereon which have excellent characteristics with a minimum amount of ink. It has been found that a product of the present invention can be economically made by a process wherein a paper substrate is coated with a thin film of an electron-beam curable resin precursor which is immediately cured in situ and then subjected to a conventional printing operation to provide a continuous or discrete, inked image on the cured resin film having a relatively smooth and impervious surface as compared to the paper which provides a glossy appearance to the paper. Surprisingly, despite the smooth nature of the surface of the cured resin film and the impervious nature of the resin film, conventional ink has good affinity for the resin surface and can be printed thereon to provide images of excellent intensity or brilliance. Also surprisingly, the excellent inked images are obtained despite the use of less ink than would be required to print conventional paper to obtain corresponding images.

Paper substrates suitable for use in the present invention will be flexible and can be provided in roll form so as to be particularly adapted for a continuous process. Typically, the paper will be about 2 to about 20 mils thick and a 15 to 80 lb. (per ream) paper and will have a surface pretreated to provide a smoother surface upon which the resin film of the present invention will be coated. Suitable pretreatments include paper sizing, calendering techniques, or machine glazing or polishing techniques. For example, the paper substrate can be passed over a heated drum rotating at a speed different than the paper substrate thereby polishing, i.e., smoothing the surface of the paper substrate. Speed differentials on the order of about 1:10 or 10:1 are suitable for this purpose. Of course, other conventional means for mechanically leveling or polishing one or both surfaces of the paper substrate are consistent with, and contemplated to be within, the scope of the present invention. It will be appreciated by those skilled in the art from the following disclosure of the present invention that such pretreatments are advantageous to obtain optimum results with minimum amounts of resin precursor in practicing the present invention.

In order that the final product will be flexible and to economize on materials, it is necessary that the resin film on the paper substrate be very thin. In general the cross-section thickness of the resin film should be from about 0.05 to about 3.0 mils, preferably from about 0.1 to about 0.3 mils. To achieve a resin film of this thickness, the viscosity of the precursor must be sufficiently low so that the precursor will flow onto or wet the paper substrate to form a thin, smooth layer or film. It is also desirable that the resin precursor be of a low viscosity so that it will penetrate or impregnate the adjacent paper substrate surface. By penetrating into the paper substrate, the resin precursor, when cured, provides a strong mechanical bond between the resin film and the paper substrate. It is believed that fibers, including paper fibers and fibers or flake or additive, e.g. clay, of the paper substrate contained in the resin film as composite reinforcements and holding members in an amount of up to about 25% by weight of the resin film is most satisfactory in the present invention. These fibers also are believed to strengthen the resin film itself and further contribute to the total strength of the paper product of this invention.

On the other hand it is necessary that the resin precursor cover fibers or other paper substrate material extending above the surface of the paper substrate to provide a smooth and uninterrupted resin film surface. Furthermore the precursor must not penetrate too far into the paper substrate if the end product is to have the desired flexibility and if use of an excessive amount of resin precursor is to be avoided. Hence, the viscosity of the precursor must be high enough so that penetration into the paper substrate prior to curing is limited to a maximum depth of about one quarter of the thickness of the paper substrate. Preferably the amount of resin precursor is less than 10% by weight of the paper substrate.

Suitable resin precursors have viscosities of from about 1,000 to about 5,000 centipoise at the temperature at which they are applied to the paper substrate. Precursors having viscosities of from about 2,000 to about 3,000 centipoise are preferred while those having viscosities of from about 2,600 to about 2,700 are most preferred. Resin precursors of these viscosities can be applied to the paper substrate by means of a finely etched reverse gravure roll of 100–300 quad, depending on desired film thickness although any method capable of coating a thin film of the resin precursor onto the paper substrate can be used.

It has been found that the desired smooth film of precursor which requires a relatively low viscosity and the desired limited penetration which requires a relatively high viscosity can be obtained by initiating the curing of the precursor of the present invention immediately after coating the paper substrate. This immediate cure can be accomplished by employing radiation curable resin precursors and curing by means of electron beam radiation. The precursor must consist essentially of reactive monomers or oligomers which will substantially completely polymerize. By this is meant that less than 10% and preferably less than 1% of monomeric precursor material will remain after the precursor has been cured. Resin precursors comprising a non-polymerizing solvent are not satisfactory as the solvent is detrimental to achieving the desired smooth film surface. There are many suitable resin precursors specifically designed for electron beam curing and which are commercially available including polyester, urethane, acrylic, epoxy and vinyl-based resin precursors and mixtures thereof. Acrylate substituted urethane resin precursors are preferred.

As indicated above, it is necessary to contact the resin precursor with electron radiation to initiate curing immediately after the resin precursor is applied to the paper substrate. In accordance with this process the resin film is isolated to a surface portion on one side of the cross-section thickness of the paper substrate and any substantial detrimental effect on the flexibility of the paper substrate is avoided. By the term "immediate" curing is meant that the curing step is initiated and carried out quickly enough to achieve the above-mentioned results. Generally, the curing step must be initiated within a few seconds of the time that the resin precursor contacts the paper substrate. It has been found that the cure itself is substantially complete within a few milliseconds of exposure of the cured resin precursor to the high energy electron beam. However, several hundred milliseconds may be allowed for transit of the substrate web from a point of application of the cured resin precursor to the curing station. Although the basic cure takes place in a few milliseconds, as mentioned above, additional curing takes place in the web for days and even weeks, but does not limit processing or use of the product at all. The initial cure is characterized by an apparent freedom from tackiness as observed by hand and visually.

The resin precursor can be cured by means of conventional electron beam machinery such as disclosed in U.S. Pat. Nos. 3,702,412 Nov. 7, 1972 to Quintal, 3,769,600 Oct. 30, 1973 to Denholm et al. and 3,780,308 Dec. 18, 1973 to Nablo. These machines provide an electron curtain transverse to movement of a substrate web contacted thereby and can provide a beam or sheet of 2–3 Megarads over 50 to 70 inches of web width which is suitable to cure the resin film in accordance with the present invention. Such machines are available commercially from Energy Sciences, Inc. of Burlington, Massachusetts under the trade name Electrocurtain ®. Preferably an inert gas is passed over the coated web in the beam working zone to limit oxygen contamination. The inert gas may comprise argon, nitrogen or the like.

After the resin has been substantially cured, an inked image is placed on the resin by means of a conventional printing step. Surprisingly, the resin layer absorbs less ink than would conventional paper but has good adhesion of the ink resulting in an intense or bright image with unusually small quantities of ink. While the curing step must be carried out immediately after application of the resin precursor to the paper substrate, the printing step can be carried out at any time after the resin precursor is substantially cured. Suitable inks for use in the present process include conventional nitrocellulose, polyamide and acrylic inks. It is not necessary to pretreat the resin-coated paper surface or to employ specialty or expensive inks to gain the advantages of the present invention. The resin coated paper substrates of this invention can be printed at high rates associated with the production of printed matter for mass distribution or with manufacturing processes enjoying economy of scale.

In an alternative embodiment of the present invention, the resin precursor coating is applied to both surfaces of the paper substrate to provide a printing surface of both surfaces as might be desirable, for example in a magazine page or for decorative purposes. However, the additional expense of coating both paper surfaces is not warranted where the desired printing advantages are desired on one side only such as would likely be the case if the end use was a poster or packaging end use.

The printed paper products made in accordance with this invention can be used in graphic arts, for decorative furnishings (e.g., drapes, wallpaper), wrapping purposes, such as Christmas wrapping paper, or other packaging applications such as food and chemical wrapping where, it should be noted, the relatively impervious nature of the resin coating offers additional moisture or other fluid blockage advantages, and in clothing exterior layers or liners. Of course, protective coatings can be applied over the printed image or images in a manner well known in the art and consistent with the present invention.

The following example is offered to further illustrate the present invention.

EXAMPLE

A roll of a paper substrate (28 lb./ream paper coated on one surface with a sizing material) is unrolled and passed through an offset gravure printing station having a 200 quad impression roller and which coats a thin film of a radiation curable acrylic resin precursor onto the sized surface of the paper substrate. The precursor has a viscosity of about 2,650 centipoise and is applied to the paper in an amount of about 2 lbs./ream. Less than one second after application to the paper, the paper is passed through an electron beam apparatus where the resin precursor, Mobil 76X414B, is contacted with electron beam radiation until the resin is cured as is evidenced by a lack of tack or sticky feel when touched. The paper is then wound onto a roller and transported to a conventional printing station where an image is placed onto the surface of the cured resin by placing discrete portions of ink layers thereon. The ink placed onto the surface of the cured resin is a conventional nitrocellulose ink. An intense image of excellent contrast with unprinted portions of the cured resin surface is obtained although less ink is employed than would be used in conventional paper printing process.

It is evident that those skilled in the art, once given the benefit of the foregoing disclosure, may now make modifications of the specific embodiments described herein without departing from the spirit of the present invention and such modifications are to be considered within the scope of this invention which is limited solely by the scope and spirit of the appended claims.

What is claimed is:

1. The process of printing a modified paper substrate comprising the steps of:

(A) coating a surface of a paper substrate with a thin film consisting essentially of a radiation curable resin precursor;

(B) immediately contacting said film with electron radiation sufficient to cure said precursor before said precursor has penetrated into said paper substrate a distance sufficient to cause detrimental stiffening thereof; and (C) printing on the exposed surface of said film.

2. The process of claim 1 wherein said film is sufficiently thick to cover substantially all fibrous paper material projecting from said surface.

3. The process of claim 2 wherein said film has a thickness after curing of from about 0.05 mils to about 3.0 mils.

4. The process of claim 3 wherein said film is cured before penetrating into said paper substrate more than a quarter of the thickness of said paper substrate.

5. The process of claim 4 wherein said film has imbedded therein, from about 5% to about 25% of paper fibers.

6. The process of claim 5 wherein said resin precursor has a viscosity of from about 1,000 to about 5,000 centipoise.

7. The process of claim 6 wherein said viscosity is from about 2,000 to about 3,000 centipoise.

8. The process of claim 7 wherein said viscosity is from about 2,600 to about 2,700 centipoise.

9. The process of claim 6 wherein said printing step is carried out with an ink selected from the group consisting of nitrocellulose, polyamide and acrylic inks.

10. The process of claim 9 wherein said paper substrate has a thickness of from about 2 mils to about 20 mils.

11. A printed paper product comprising a paper substrate with a smooth continuous, coherent resin film on one side thereof, said film having limited penetration into the paper substrate, being substantially entirely within the adjacent quarter of the paper cross-section thickness, and further comprising fibrous matter of the paper substrate intermixed in said resin film up to 25 percent thereof, at least portions of the outer surface of said resin film being overcoated with ink.

12. A printed paper product as recited in claim 11 wherein said resin film is a radiation cured resin film.

13. A printed paper product as recited in claim 12 wherein said ink is selected from the group consisting of nitrocellulose, polyamide and acrylic ink.

14. A printed paper product as recited in claim 12 wherein said paper substrate has a cross-section thickness of from about 2 to about 20 mils, and said film has a cross-section thickness of from about 0.05 to about 3.0 mils.

* * * * *

Notice of Adverse Decision in Interference

In Interference No. 100,631, involving Patent No. 4,177,314, R. W. Steeves, METHOD OF PRINTING PAPER, final judgment adverse to the patentee was rendered Dec. 13, 1983, as to claims 1–10.

[*Official Gazette June 5, 1984.*]